US008770551B2

(12) United States Patent
Li

(10) Patent No.: US 8,770,551 B2
(45) Date of Patent: Jul. 8, 2014

(54) SINGLE-WAVE BEAM GUARDRAIL PLATE AND SINGLE-WAVE BEAM STEEL GUARDRAIL

(75) Inventor: Jianwei Li, Beijing (CN)

(73) Assignee: China Communications Safe Road (Beijing) Technology Co. Ltd, Beijing (CN)

( * ) Notice: Subject to any disclaimer, the term of this patent is extended or adjusted under 35 U.S.C. 154(b) by 485 days.

(21) Appl. No.: 13/131,279

(22) PCT Filed: Dec. 4, 2009

(86) PCT No.: PCT/CN2009/001371

§ 371 (c)(1),
(2), (4) Date: May 26, 2011

(87) PCT Pub. No.: WO2010/072047

PCT Pub. Date: Jul. 1, 2010

(65) Prior Publication Data

US 2011/0233495 A1 Sep. 29, 2011

(30) Foreign Application Priority Data

Dec. 22, 2008 (CN) ..... 2008 1 0187285
Jun. 29, 2009 (CN) ..... 2009 1 0148556

(51) Int. Cl.
*E01F 15/00* (2006.01)
*E01F 15/04* (2006.01)

(52) U.S. Cl.
CPC ..... *E01F 15/043* (2013.01); *E01F 15/0438* (2013.01)
USPC ..... 256/13.1

(58) Field of Classification Search
CPC ..... E01F 15/02; E01F 15/025
USPC ..... 256/13.1
See application file for complete search history.

(56) References Cited

U.S. PATENT DOCUMENTS 1,680,548 A * 8/1928 Keiser ..... 256/13.1
5,284,326 A 2/1994 Chiovitti et al.

(Continued)

FOREIGN PATENT DOCUMENTS

CN 2481750 Y 3/2002
CN 2700392 Y 5/2005

(Continued)

OTHER PUBLICATIONS

International Search Report for PCT/CN2009/001371, mailed Mar. 18, 2010.

(Continued)

*Primary Examiner* — Victor MacArthur
(74) *Attorney, Agent, or Firm* — Harness, Dickey & Pierce, P.L.C.

(57) ABSTRACT

A waveform beam guardrail plate and a waveform beam steel guardrail are provided. In which, the guardrail plate includes a main body (15) and two rings (16, 17) with a same structure installed axial symmetrically on an upper and a lower edges of the main body; furthermore, a transverse section of the main body has an arc shape, and the upper and lower edges of the main body of the guardrail plate are curled inwardly and helically toward a protruding direction of the main body of the guardrail plate for forming the two rings (16, 17). The waveform beam steel guardrail includes numbers of guardrail plate units (1, 11), upright posts (2) and preventing blocks (3), and the guardrail plate units (1, 11) are connected with the upright posts (2) by the preventing blocks (3).

14 Claims, 7 Drawing Sheets

(56) References Cited

U.S. PATENT DOCUMENTS

| | | | | |
|---|---|---|---|---|
| 5,547,310 | A * | 8/1996 | Muller | 256/13.1 |
| 6,554,256 | B2 | 4/2003 | Ochoa | |
| 6,558,067 | B2 * | 5/2003 | Ochoa | 256/13.1 |
| 6,830,407 | B1 * | 12/2004 | Ochoa | 404/6 |

FOREIGN PATENT DOCUMENTS

| | | | |
|---|---|---|---|
| CN | 200967939 | Y * | 10/2007 |
| EP | 1762660 | A1 | 3/2007 |
| JP | S61-93514 | U | 6/1986 |
| JP | H09-242034 | A | 9/1997 |
| JP | 2004027825 | A | 1/2004 |
| JP | 2004360208 | A | 12/2004 |
| JP | 2006328633 | A | 12/2006 |
| JP | 2006342640 | A | 12/2006 |
| KR | 20020002418 | | 5/2002 |

OTHER PUBLICATIONS

Canadian Office Action regarding Application No. 2,747,568, dated Dec. 10, 2012.

Korean Office Action regarding Application No. 10-2011-7013546, dated Nov. 12, 2012. Translation provided by Unitalen Attorneys at Law.

* cited by examiner

SINGLE-WAVE BEAM GUARDRAIL PLATE AND SINGLE-WAVE BEAM STEEL GUARDRAIL

CROSS-REFERENCE TO RELATED APPLICATIONS

This application is a 371 U.S. National Stage of International Application No. PCT/CN2009/001371 titled "Waveform Beam Guardrail Plate and Waveform Beam Steel Guardrail", filed Dec. 4, 2009. The present application claims the benefit of priority to Chinese patent application No. 200810187285.9 titled "Steppedly Eliminating Energy Single-wave Beam Anti-collision Guardrail", filed with the Chinese State Intellectual Property Office on Dec. 22, 2008 and the benefit of priority to Chinese patent application No. 200910148556.4 titled "Single-wave Beam Steel Guardrail", filed with the Chinese State Intellectual Property Office on Jun. 29, 2009. The entire disclosures thereof are incorporated herein by reference.

FIELD OF THE INVENTION

The present invention relates to a vehicle anti-collision facility on a road and a bridge, particular to a single-wave beam guardrail plate and a single-wave beam steel guardrail.

BACKGROUND OF THE INVENTION

With the rapid development of the road construction and the transportation industry in China, the traffic safety faces a grim situation. The anti-collision guardrail, as a security facility, plays an important role in protecting the traffic safety on roads and bridges.

Generally, the anti-collision guardrail mainly includes three types, i.e., the rigid guardrail, the semi-rigid guardrail and the flexible guardrail. Among them, the rigid guardrail primarily includes the concrete guardrail such as the New Jersey guardrail and the combined guardrail. Such a concrete guardrail has overlarge rigidity, so the abilities of cushioning and absorbing vehicle kinetic energy are weak. When the gravity center of a vehicle is relatively high, the vehicle is prone to turn over the concrete guardrail after it crashed against the concrete guardrail; and when the gravity center of a vehicle is relatively low, the vehicle is prone to turn over laterally after it crashed against the concrete guardrail. The semi-rigid guardrail primarily includes the waveform beam guardrail and the beam-column guardrail. The waveform beam guardrail includes the two-wave guardrail and the three-wave guardrail. Such a waveform beam guardrail absorbs the vehicle kinetic energy by the upward and downward deformations of the steel plate, which results in a large consumption of steel material and poor landscape effects. The beam-column guardrail is constituted of a plurality of parallel steel pipes in the shape of circle or rectangle. The collision grade of these beam-column guardrails is relatively low.

At present, the anti-collision guardrail used on roads and bridges in China is designed and provided for all vehicles, regardless of a big vehicle or a small vehicle. All vehicles crash against such guardrail having the same anti-collision grade when a collision occurs. However, the anti-collision guardrail for protecting small vehicles needs flexible design, and the anti-collision guardrail for protecting big vehicles needs rigid design. The semi-rigid anti-collision guardrail has a relatively low protection grade for big vehicles and has a relatively large consumption of steel material.

In fact, the anti-collision guardrail, as an important safety protection facility, should have a sufficient cushioning capability while stopping a vehicle out of control. That is, the anti-collision guardrail should have not only a sufficient anti-collision grade but also a sufficient cushioning capability, so as to gradually reduce the vehicle kinetic energy. When being crashed by a small vehicle, the anti-collision guardrail should stop or smoothly make the small vehicle drive out at the expected angle by use of the cushioning capability thereof. When being crashed by a big vehicle, the anti-collision guardrail should firstly cushion the big vehicle and then stop or make the big vehicle drive out at the expected angle, so that the big vehicle cannot pass through or turn over the guardrail. In addition, the anti-collision guardrail on roads in a city and roads in a scenic zone should produce a certain aesthetic effect.

SUMMARY OF THE INVENTION

In view of the above problems, the object of the present invention is to provide a single-wave beam guardrail plate and a single-wave beam steel guardrail, which may achieve advantages such as a high anti-collision grade, a strong cushioning capability and a beautiful appearance.

In order to achieve the object, the present invention adopts the following technical solutions. A single-wave beam guardrail plate includes a guardrail plate body integrally formed by rolling, and two energy-accumulating rings which have the same structure and are symmetrically disposed in the axial direction at an upper edge and a lower edge of the guardrail plate body. The cross section of the guardrail plate body is in the shape of arc. The two energy-accumulating rings are formed by the upper edge and the lower edge of the guardrail plate body being curled inwardly and helically toward a convex direction of the guardrail plate body, respectively.

Further, a cross section of each of the two energy-accumulating rings is of a pipe-in-pipe structure in which a first steel pipe is inserted inside a second steel pipe and connected with an inner wall of the second steel pipe. The walls of the first steel pipe and the second steel pipe have a common section near the convex portion of the guardrail plate body.

Further, in the two energy-accumulating rings, a common tangent of an outer circle of the first steel pipe of the first energy-accumulating ring and an outer circle of the first steel pipe of the second energy-accumulating ring is perpendicular to a radius of the guardrail plate body. A common tangent of an outer circle of the second steel pipe of the first energy-accumulating ring and an outer circle of the second steel pipe of the second energy-accumulating ring is perpendicular to the radius of the guardrail plate body. A middle point of the common tangent of the outer circle of the second steel pipe of the first energy-accumulating ring and the outer circle of the second steel pipe of the second energy-accumulating ring coincides with a middle point of the arc of the guardrail plate body. A connection line between the center of the inner circle or the outer circle of the first steel pipe of the first energy-accumulating ring and the center of the inner circle or the outer circle of the first steel pipe of the second energy-accumulating ring is perpendicular to the radius of the guardrail plate body. A connection line between the center of the inner circle or the outer circle of the second steel pipe of the first energy-accumulating ring and the center of the inner circle or the outer circle of the second steel pipe of the second energy-accumulating ring is perpendicular to the radius of the guardrail plate body. In the first energy-accumulating ring or second energy-accumulating ring, an inner circle of the first steel pipe is an inscribed circle of an inner circle of the second steel pipe.

Further, in the pipe-in-pipe structure, the radius of the outer circle of the first steel pipe is less than 60% of the radius of the outer circle of the second steel pipe. In the pipe-in-pipe structure, a wire rope or steel strand passes through each first steel pipe in an axial direction such that a prestress is generated in each guardrail plate subunit.

In addition, the present invention adopts another technical solution as follows. A single-wave beam steel guardrail using above single-wave beam guardrail plate, comprises a plurality of guardrail units sequentially disposed in a transverse direction, in which the plurality of guardrail units are connected by assembling, wherein each of the plurality of guardrail units comprises a plurality of posts disposed upright at intervals, a single layer of or a plurality of layers of guardrail plate subunit(s) disposed transversely at the same side of the posts and being perpendicular to the posts, and a plurality of clog-proof blocks provided between the single layer of or the plurality of layers of guardrail plate subunit(s) and corresponding posts; a structure of each guardrail plate subunit is the same as that of the single-wave beam guardrail plate; the single layer of or the plurality of layers of guardrail plate subunit(s) and corresponding clog-proof blocks are connected by assembling, and the clog-proof blocks and corresponding posts are connected by assembling; and the single layer of or the plurality of layers of guardrail plate subunit(s) of each of the plurality of guardrail units and corresponding guardrail plate subunit(s) of adjacent guardrail unit are connected by assembling.

Further, assembly plate(s) for connecting adjacent guardrail plate subunits is provided near corresponding posts at the connections between the single layer of or the plurality of layers of guardrail plate subunit(s) of each guardrail unit and corresponding guardrail plate subunit(s) of the adjacent guardrail unit, the assembly plate(s) and corresponding guardrail plate subunit(s) are connected by assembling, and the assembly plate(s) and corresponding clog-proof block(s) are connected by assembling.

Further, the assembly plate is a connection steel plate or a guardrail plate without energy-accumulating rings.

Further, reinforcing steel pipe(s) is provided in the axial direction in arc groove(s) of the single layer of or the plurality of layers of guardrail plate subunits of each guardrail unit respectively, the reinforcing steel pipe(s) is located between corresponding assembly plate(s) and clog-proof block(s); each layer of the guardrail plate subunits and corresponding assembly plate, the reinforcing steel pipe are connected by assembling, and each layer of the guardrail plate subunit and corresponding clog-proof block are connected by assembling.

Further, in each guardrail unit, distances between the plurality of layers of guardrail plate subunits and corresponding posts are the same or gradually reduced from the bottom to the top in the vertical direction; widths and a thicknesses of the plurality of layers of guardrail plate subunits are the same or gradually increased from the bottom to the top in the vertical direction; diameters of the energy-accumulating rings of the plurality of layers of guardrail plate subunits are the same or gradually increased from the bottom to the top in the vertical direction.

Further, in each guardrail unit, diameters of the reinforcing steel pipes provided correspondingly to the plurality of layers of guardrail plate subunits are the same or gradually reduced from the bottom to the top in the vertical direction.

Further, in the single-layer of or the plurality of layers of guardrail plate subunits, each layer of guardrail plate subunit include single-side guardrail plate subunit or double-side guardrail plate subunit; a structure of the single-side guardrail plate subunit is the same as that of the single-wave beam guardrail plate, and the double-side guardrail plate subunit is formed by oppositely assembling two single-wave beam guardrail plates together; and in the double-side guardrail plate subunit, the arc convex portions of the guardrail plate bodies of the two single-wave beam guardrail plates are disposed oppositely, and the guardrail plate bodies thereof are connected by assembling.

With the single-wave beam steel guardrail according to the embodiments of the present invention, when a small vehicle crashes with the single-wave beam steel guardrail, in the vertical direction, the guardrail plate subunit at the bottom layer having a relatively low rigidity is firstly destroyed, and the energy-accumulating rings of the guardrail plate subunit at the bottom layer are rapidly opened to absorb the vehicle kinetic energy. When a big vehicle crashes with the single-wave beam steel guardrail, the guardrail plate subunit at the bottom layer having a relatively low rigidity and the reinforcing steel pipe at the bottom layer are firstly destroyed, and then the guardrail plate subunit at the middle layer having a relatively high rigidity and the reinforcing steel pipe at the middle layer are destroyed, and finally the guardrail plate subunit at the top layer having a maximum rigidity and the reinforcing steel pipe at the top layer are destroyed.

For the small vehicle, when it crashes with the single-wave beam steel guardrail, only the single-wave beam guardrail plate and the reinforcing steel pipe located at the bottom layer are destroyed. For the big vehicle having a relatively high speed and a relatively great mass, when it crashes with the single-wave beam steel guardrail, the rigidity of the single-wave beam steel guardrail is changed from flexible to semi-rigid, and then from semi-rigid to rigid, which may steppedly cushion and release the vehicle kinetic energy. Besides, such a streamline design of the single-wave beam steel guardrail also may properly guide the running of the vehicle.

In addition, when the vehicle crashes with the single-wave beam steel guardrail, the energy-accumulating rings may be curled, which may prevent the single-wave beam guardrail plate from tearing from the upper side and the lower side of the guardrail plate body due to an excessive collision force, or the energy-accumulating rings also may be opened to rapidly absorb the vehicle kinetic energy. Beside, the energy-accumulating rings may form a symmetrical landscape patterns together with the arc guardrail plate body.

Among the single-wave beam guardrail plate and the single-wave beam steel guardrail according to the embodiments of the present invention, the single-wave beam guardrail plate includes a guardrail plate body integrally formed by rolling, and two energy-accumulating rings which have the same structure and are symmetrically disposed in the axial direction at the upper edge and the lower edge of the guardrail plate body. The cross section of the guardrail plate body is in the shape of arc. The two energy-accumulating rings are formed by the upper edge and the lower edge of the guardrail plate body being curled inwardly and helically toward a convex direction of the guardrail plate body, respectively. Based on the single-wave beam guardrail plate, a single-wave beam steel guardrail is provided. When a small vehicle crashes with the single-wave beam steel guardrail, in the vertical direction, only the single-wave beam guardrail plate located at the lower part of the post and having a relatively low rigidity is destroyed. When the single-wave beam guardrail plate is being destroyed, corresponding energy-accumulating rings are rapidly opened to absorb the vehicle kinetic energy. When a big vehicle crashes with the single-wave beam steel guardrail, in the vertical direction, the single-wave beam guardrail plate located at the lower part of the post having a relatively low rigidity is firstly destroyed, and then above single-wave beam guardrail plates with a relatively high rigidity are then destroyed in turn. Thus, the vehicle kinetic energy may be cushioned and steppedly eliminated, and the collision time is prolonged to provide a good protection for drivers and passengers; so as to overcome the disadvantages of low anti-collision grade and weak cushion capacity and unsightly appearance in the prior art. Therefore, the advantages of high anti-collision grade, strong cushion capacity and beautiful appearance may be achieved.

The other features and advantages of the present invention will be described below and will partially become apparent from the description, or may be understood from the embodiments of the present invention. The objects and other advantages of the present invention may be achieved and obtained by structures specifically described in the description, claims and drawings.

The technical solutions of the present invention will be further described in detail in conjunction with drawings and embodiments.

BRIEF DESCRIPTION OF THE DRAWINGS

Drawings are provided for further understanding the present invention and form a part of the specification, and are used to illustrate the present invention together with embodiments of the present invention, but not intended to limit the present invention, in which.

Figure 1:
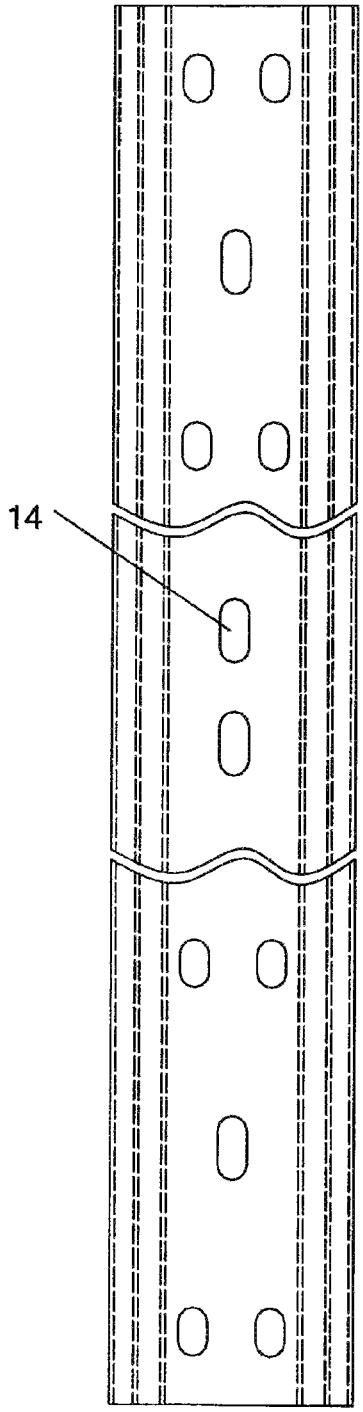
FIG. 1 is a schematic partial back view of the structure of a single-wave beam guardrail plate according to the present invention.

| Reference numerals in FIGURES of embodiments of the present invention: | |
|---|---|
| 1- | first guardrail plate subunit; |
| 2- | post; |

-continued

| Reference numerals in FIGURES of embodiments of the present invention: | |
|---|---|
| 3- | clog-proof block; |
| 4- | reinforcing steel pipe; |
| 5- | assembly plate; |
| 6- | assembly bolt; |
| 7- | assembly nut; |
| 8- | connection bolt; |
| 9- | connection nut; |
| 10- | wire rope or steel strand; |
| 11- | second guardrail plate subunit; |
| 12- | first fixing bolt; |
| 13- | first fixing nut; |
| 14- | bolt hole; |
| 15- | guardrail plate body; |
| 16- | first energy-accumulating ring; |
| 17- | second energy-accumulating ring; |
| 18- | first steel pipe; |
| 19- | second steel pipe. |

DETAILED DESCRIPTION OF THE INVENTION

Hereinafter, the preferred embodiments of the present invention will be described with reference to drawings. It should be noted that the preferred embodiments described herein are only used for illustrating and explaining the present invention, but not intended to limit the present invention.

Embodiments of the Single-Wave Beam Guardrail Plate

First Embodiment

Figure 2:
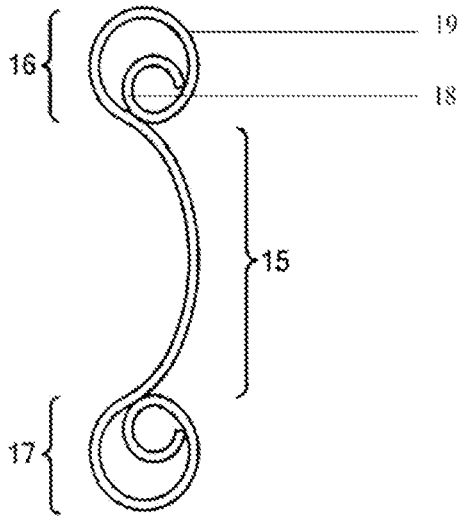
FIG. 2 is a schematic left view of the structure of the single-wave beam guardrail plate according to the present invention.

According to one embodiment of the present invention, a single-wave beam guardrail plate is provided. As shown in FIGS. 1 and 2, the embodiment includes a guardrail plate body 15 integrally formed by rolling, and two energy-accumulating rings which have the same structure and are symmetrically disposed in the axial direction at the upper edge and the lower edge of the guardrail plate body 15. The cross section of the guardrail plate body 15 is in the shape of arc. The two energy-accumulating rings are formed by the upper edge and the lower edge of the guardrail plate body 15 being curled inwardly and helically toward a convex direction of the guardrail plate body 15, respectively.

Further, the cross section of each of the two energy-accumulating rings described above is of a pipe-in-pipe structure in which a first steel pipe 18 is inserted inside a second steel pipe 19 and connected with the inner wall of the second steel pipe 19. The walls of the first steel pipe 18 and the second steel pipe 19 have a common section near the convex portion of the guardrail plate body 15.

Further, for the two energy-accumulating rings described above, a common tangent of an outer circle of the first steel pipe 18 of the first energy-accumulating ring 16 and an outer circle of the first steel pipe 18 of the second energy-accumulating ring 17 is perpendicular to the radius of the guardrail plate body 15. Similarly, a common tangent of an outer circle of the second steel pipe 19 of the first energy-accumulating ring 16 and an outer circle of the second steel pipe 19 of the second energy-accumulating ring 17 is perpendicular to the radius of the guardrail plate body 15.

Further, the middle point of the above common tangent of the outer circle of the second steel pipe 19 of the first energy-accumulating ring 16 and the outer circle of the second steel pipe 19 of the second energy-accumulating ring 17 coincides with the middle point of the arc of the guardrail plate body 15.

Further, a connection line between the center of the inner circle or the outer circle of the first steel pipe 18 of the first energy-accumulating ring 16 and the center of the inner circle or the outer circle of the first steel pipe 18 of the second energy-accumulating ring 17 is perpendicular to the radius of the guardrail plate body 15. Similarly, a connection line between the center of the inner circle or the outer circle of the second steel pipe 19 of the first energy-accumulating ring 16 and the center of the inner circle or the outer circle of the second steel pipe 19 of the second energy-accumulating ring 17 is perpendicular to the radius of the guardrail plate body 15.

Further, the inner circle of the first steel pipe 18 is an inscribed circle of the inner circle of the second steel pipe 19 in the above first energy-accumulating ring 16 or second energy-accumulating ring 17.

Further, in the above pipe-in-pipe structure, the radius of the outer circle of the first steel pipe 18 is less than 60% of the radius of the outer circle of the second steel pipe 19.

In addition, in this embodiment, circular or elliptical bolt holes 14 may be symmetrically provided on the guardrail plate body 15.

Second Embodiment

The present embodiment is different from the above-described embodiment in that the radius of the outer circle of the first steel pipe is less than 55% of the radius of the outer circle of the second steel pipe in the above pipe-in-pipe structure.

Third Embodiment

The present embodiment is different from the above-described embodiments in that the radius of the outer circle of the first steel pipe is less than 50% of the radius of the outer circle of the second steel pipe in the above pipe-in-pipe structure.

Embodiments of the Single-Wave Beam Steel Guardrail

First Embodiment

Figure 3:
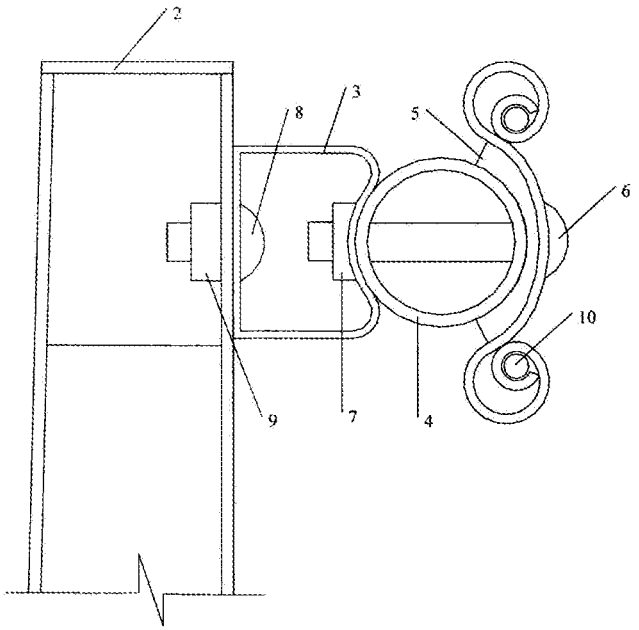
FIG. 3 is a schematic left view of the structure of a single-layer single-wave beam steel guardrail of the single-wave beam steel guardrails according to the present invention.

According to the embodiments of the present invention, based on the above-described single-wave beam guardrail plates, a single-wave beam steel guardrail is provided. As shown in FIG. 3, this embodiment includes a plurality of guardrail units sequentially disposed in the transverse direction. The plurality of guardrail units are connected by assembling. A single-layer guardrail plate subunit in each of the plurality of guardrail units is connected with a corresponding guardrail plate subunit in adjacent guardrail unit by assembling. In this embodiment, the number of the guardrail units may be determined according to the actual length of roads or bridges. In addition, the structure of the guardrail plate subunit is the same as that of the single-wave beam guardrail plate, referring to associated description of the embodiments of the single-wave beam guardrail plate, which will not described repeatedly.

Each of the plurality of guardrail units described above includes a post disposed upright, a single-layer guardrail plate subunit disposed transversely at the same side of the post and being perpendicular to the post, and an clog-proof block provided between the single-layer guardrail plate subunit and the post. The single-layer guardrail plate subunit and the clog-proof block are connected by assembling, and the clog-proof block and the post are connected by assembling.

Further, an assembly plate for connecting adjacent guardrail plate subunits is provided near corresponding post at the connections between the single-layer guardrail plate subunit of the guardrail unit and corresponding guardrail plate subunit of the adjacent guardrail unit. The assembly plate and corresponding guardrail plate subunits are connected by assembling, and the assembly plate and corresponding clog-proof block are connected by assembling.

In the above embodiment, the above assembly plate may be a connection steel plate, or may be a guardrail plate without energy-accumulating rings. The plurality of guardrail plate subunits may be assembled by the connection steel plates or the guardrail plates without energy-accumulating rings. When assembled by the connection steel plates, two single-wave beam guardrail plates are connected and assembled by using a segment of steel plate abut against the arc guardrail plate body of the guardrail plate subunit. When assembled by the guardrail plate without energy-accumulating rings, the energy-accumulating rings (i.e. steel pipe) at the upper side and the lower side of both ends of one guardrail plate subunit are sawed, and the remaining guardrail plate body is disposed at the rear side of the guardrail plate bodies of adjacent two guardrail plate subunits and then the adjacent guardrail plate subunits are connected and assembled by inserting and tightening bolts through bolt holes preset on the adjacent two guardrail plate subunits.

Further, a reinforcing steel pipe is provided in the axial direction in the arc groove of the single-layer guardrail plate subunit of each guardrail unit. The reinforcing steel pipe is located between corresponding assembly plate and clog-proof block. The guardrail plate subunit and corresponding assembly plate, the reinforcing steel pipe are connected by assembling, and the guardrail plate subunit and corresponding clog-proof block are connected by assembling. In FIG. 3, the post is indicated as 2, and the clog-proof block is indicated as 3, and the reinforcing steel pipe is indicated as 4, and the assembly plate is indicated as 5.

Specifically, in FIG. 3, the single-layer guardrail plate subunit, the assembly plate, the reinforcing steel pipe and the clog-proof block are sequentially assembled by an assembly bolt 6 and an assembly nut 7, and the clog-proof block and the post are assembled by a connection bolt 8 and a connection nut 9.

Second Embodiment

The present embodiment is different from the above-described first embodiment in that, wire ropes or steel strands respectively pass through two energy-accumulating rings of the single-layer guardrail plate subunit of each guardrail unit in the axial direction to connect corresponding guardrail plate subunits of the plurality of guardrail units, such that a pre-stress is generated in each guardrail plate subunit, which allows the single-wave beam steel guardrail to have a dual characteristics of semi-rigid guardrail and flexible guardrail. In FIG. 3, the wire rope or steel strand is indicated as 10.

In this embodiment, the wire ropes or steel strands pass through two energy-accumulating rings of the single-layer guardrail plate subunit. When a vehicle crashes with the single-wave beam steel guardrail, the single-layer guardrail plate subunits of the guardrail units are assembled together to withstand the force occurred as a whole; and when the single-layer guardrail plate subunit is in a critical situation, e.g., when the single-layer guardrail plate subunit or the bolt is about to be broken due to the tension, the wire ropes or steel strands will play a role to combine the guardrail plate subunits in the same layer of the guardrail units to withstand the force together.

Third Embodiment

The present embodiment is different from the above-described first and second embodiments in that each layer of the above single-layer guardrail plate subunit may be single-side guardrail plate subunit, or may be double-side guardrail plate subunit.

Figure 8:
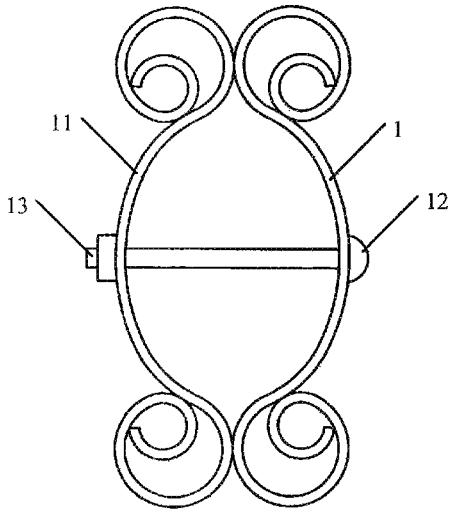
FIG. 8 is a schematic left view of the structure of a double-side single-wave beam guardrail plate in a single-wave beam steel guardrail according to the present invention.

The structure of the single-side guardrail plate subunit is the same as that of the single-wave beam guardrail plate, and the double-side guardrail plate subunit is formed by assembling two single-wave beam guardrail plates together. As shown in FIG. 8, in the double-side guardrail plate subunit, the arc convex portions of the guardrail plate bodies of the two single-wave beam guardrail plates are disposed oppositely, and the guardrail plate bodies are connected by assembling.

In FIG. 8, the double-side guardrail plate subunit includes a first guardrail plate subunit 1 and a second guardrail plate subunit 11. The guardrail plate body of the first guardrail plate subunit 1 is connected with the guardrail plate body of the second guardrail plate subunit 11 via a first fixing bolt 12 and a first fixing nut 13.

Fourth Embodiment

Figure 4:
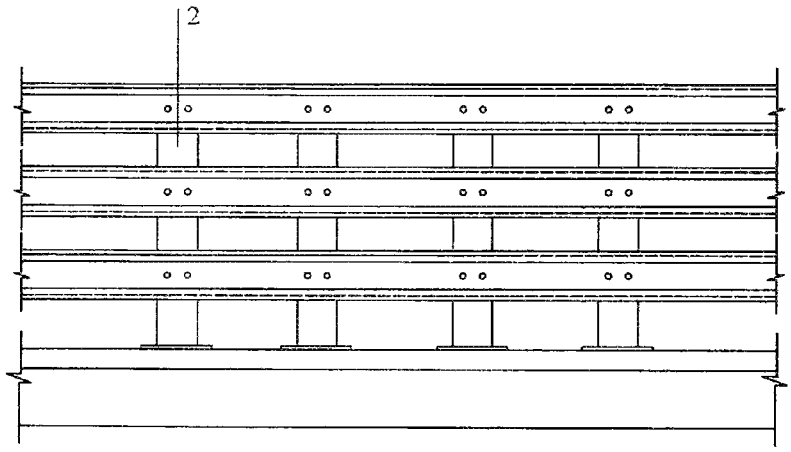
FIG. 4 is a schematic partial front view of the structure of a multi-layer single-wave beam steel guardrail of the single-wave beam steel guardrails according to the present invention.
Figure 5:
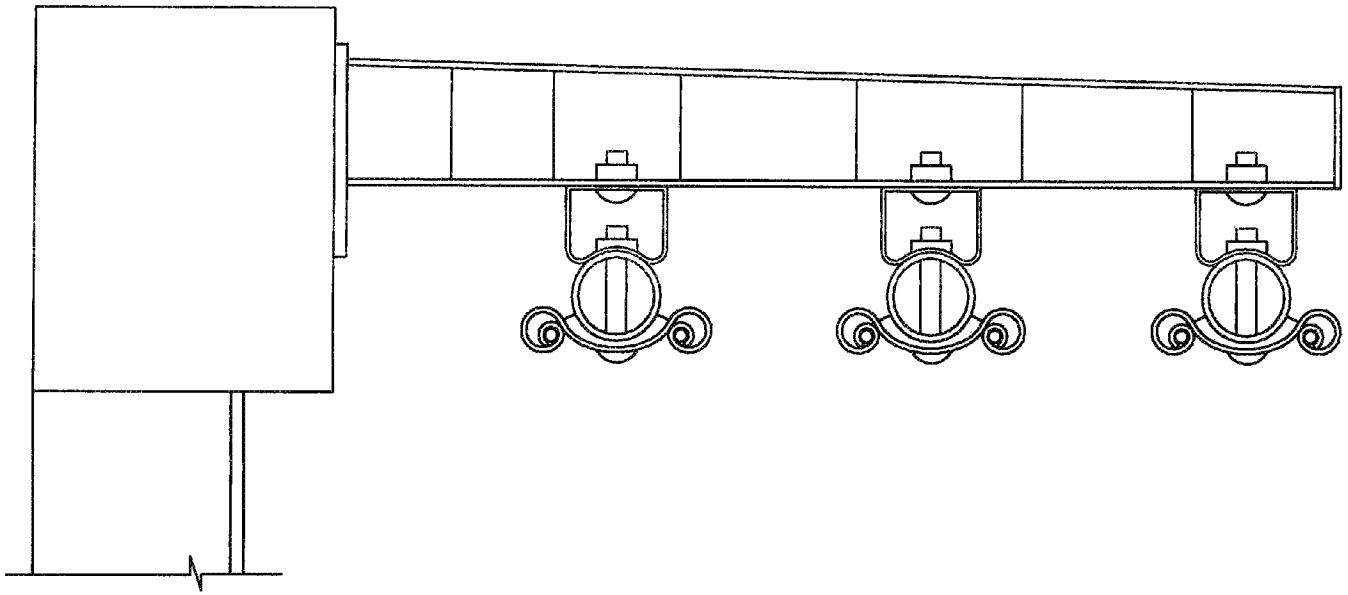
FIG. 5 is a schematic partial left view of the structure of a multi-layer single-wave beam steel guardrail of the single-wave beam steel guardrails according to the present invention.

According to the embodiments of the present invention, based on the above-described single-wave beam guardrail plates, a single-wave beam steel guardrail is provided. As shown in FIGS. 4 and 5, this embodiment includes a plurality of guardrail units sequentially disposed in the transverse direction, and the plurality of guardrail units are connected by assembling. Each guardrail unit includes a plurality of posts disposed upright at intervals, a plurality of layers of guardrail plate subunits disposed transversely at the same side of the posts and being perpendicular to the posts, and a plurality of clog-proof blocks provided between the plurality of layers of guardrail plates and corresponding posts. The plurality of layers of guardrail plate subunits and corresponding clog-proof blocks are connected by assembling, and the clog-proof blocks and corresponding posts are connected by assembling. In this embodiment, the structure of each guardrail plate subunit is the same as that of the single-wave beam guardrail plate, referring to associated description of the embodiments of the single-wave beam guardrail plate, which will not described repeatedly. In FIG. 4, the post is indicated as 2.

The plurality of layers of guardrail plate subunits of each guardrail unit and corresponding guardrail plate subunits of adjacent guardrail unit are connected by assembling.

In this embodiment, the number of the guardrail units may be determined according to the actual length of roads or bridges. Specifically, two posts and three layers of guardrail plate subunits may be provided in each guardrail unit. The two posts are disposed upright, and the three layers of guardrail plate subunits are disposed in the transverse direction.

Further, assembly plates for connecting adjacent guardrail plate subunits are provided near corresponding posts at the connections between three layers of guardrail plate subunits of each guardrail unit and corresponding guardrail plate subunits of the adjacent guardrail unit. Each assembly plate and corresponding guardrail plate subunit are connected by assembling, and each assembly plate and corresponding clog-proof block are connected by assembling. In this embodiment, the assembly plate may be a connection steel plate, or may be a guardrail plate without energy-accumulating rings. For details about the assembling by the connection steel plate and the guardrail plate without energy-accumulating rings, please refer to associated description of the above first embodiment, which will not described repeatedly.

Further, reinforcing steel pipes are provided in the axial direction in the arc grooves of three layers of guardrail plate subunits of each guardrail unit, respectively. Each of the reinforcing steel pipes is located between corresponding assembly plate and clog-proof block. Each layer of the guardrail plate subunits and corresponding assembly plates, the reinforcing steel pipes are connected by assembling, and each layer of the guardrail plate subunits and corresponding clog-proof blocks are connected by assembling.

Further, in each guardrail unit described above, the distances between three layers of guardrail plate subunits and corresponding posts are the same in the vertical direction. The widths and the thicknesses of three layers of guardrail plate subunits are the same from the bottom to the top, and the diameters of the energy-accumulating rings of three layers of guardrail plate subunits are the same from the bottom to the top.

Further, in each guardrail unit described above, the diameters of the three reinforcing steel pipes provided correspondingly to three layers of guardrail plate subunits are the same from the bottom to the top in the vertical direction.

Fifth Embodiment

The present embodiment is different from the fourth embodiment described above in that, wire ropes or steel strands respectively pass through two energy-accumulating rings of each layer of three layers of guardrail plate subunits of each guardrail unit in the axial direction to connect corresponding guardrail plate subunits of the plurality of guardrail units, such that a prestress is generated in each guardrail plate subunit, which allows the single-wave beam steel guardrail to have a dual characteristics of semi-rigid guardrail and flexible guardrail.

In this embodiment, the wire ropes or steel strands pass through two energy-accumulating rings of each layer of guardrail plate subunit. When a vehicle crashes with the single-wave beam steel guardrail, three layers of guardrail plate subunits of each guardrail unit are connected integrally by assembling to withstand the force as a whole; and when a certain layer of guardrail plate subunits is in a critical situation, e.g., when a certain layer of guardrail plate subunits or bolt is about to be broken due to the tension, the wire ropes or steel strands will play a role to combine the guardrail plate subunits in the same layer of the guardrail units to withstand the force together. In this embodiment, the wire ropes or steel strands are provided such that, the single-wave beam steel guardrail has not only the semi-rigid characteristics of the waveform beam guardrail but also the flexible characteristics of the flexible guardrail when being crashed by a vehicle, which may improve the protection ability and the cushioning ability of the single-wave beam steel guardrail.

Sixth Embodiment

The present embodiment is different from the above fourth or fifth embodiment in that, each layer of the above three layers of guardrail plate subunits may be single-side guardrail plate subunit, or may be double-side guardrail plate subunit. For the structures of the single-side guardrail plate subunit and the double-side guardrail plate subunit, please refer to associated description of the third embodiment described above, which will not described repeatedly.

Seventh Embodiment

Figure 6:
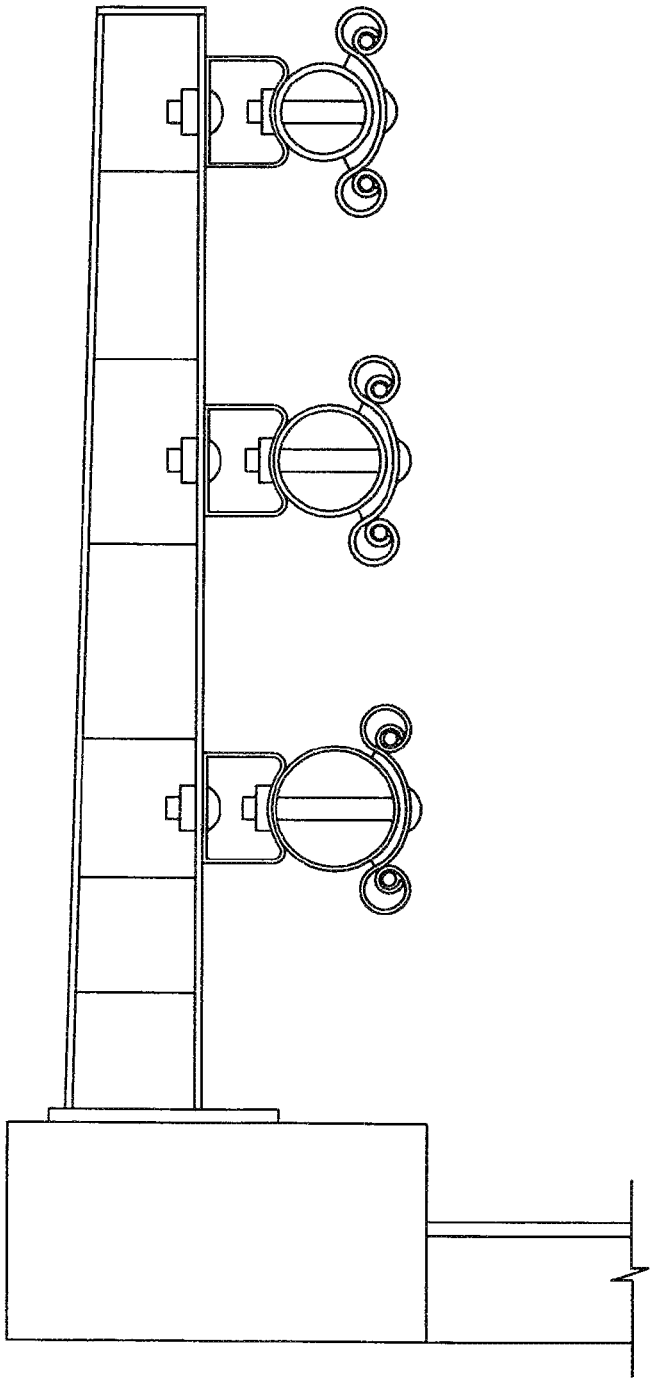
FIG. 6 is a schematic partial left view of the structure of another multi-layer single-wave beam steel guardrail of the single-wave beam steel guardrails according to the present invention.

The present embodiment is different from the above fourth to sixth embodiments in that, as shown in FIG. 6, in each guardrail unit, the diameters of the three reinforcing steel pipes provided correspondingly to three layers of guardrail plate subunits are gradually reduced from the bottom to the top in the vertical direction, and the wall thickness of them is gradually increased from the bottom to the top in the vertical direction.

For example, in this embodiment, the seamless steel pipe of 50 mm outer diameter may be selected and used for the three reinforcing steel pipes provided correspondingly to three layers of guardrail plate subunits. From the bottom to the top, the wall thickness of the bottom layer of the reinforcing steel pipe is 3 mm, and the wall thickness of the middle layer of the reinforcing steel pipe is 4 mm, and the wall thickness of the top layer of the reinforcing steel pipe is 5 mm.

Eighth Embodiment

Figure 7:
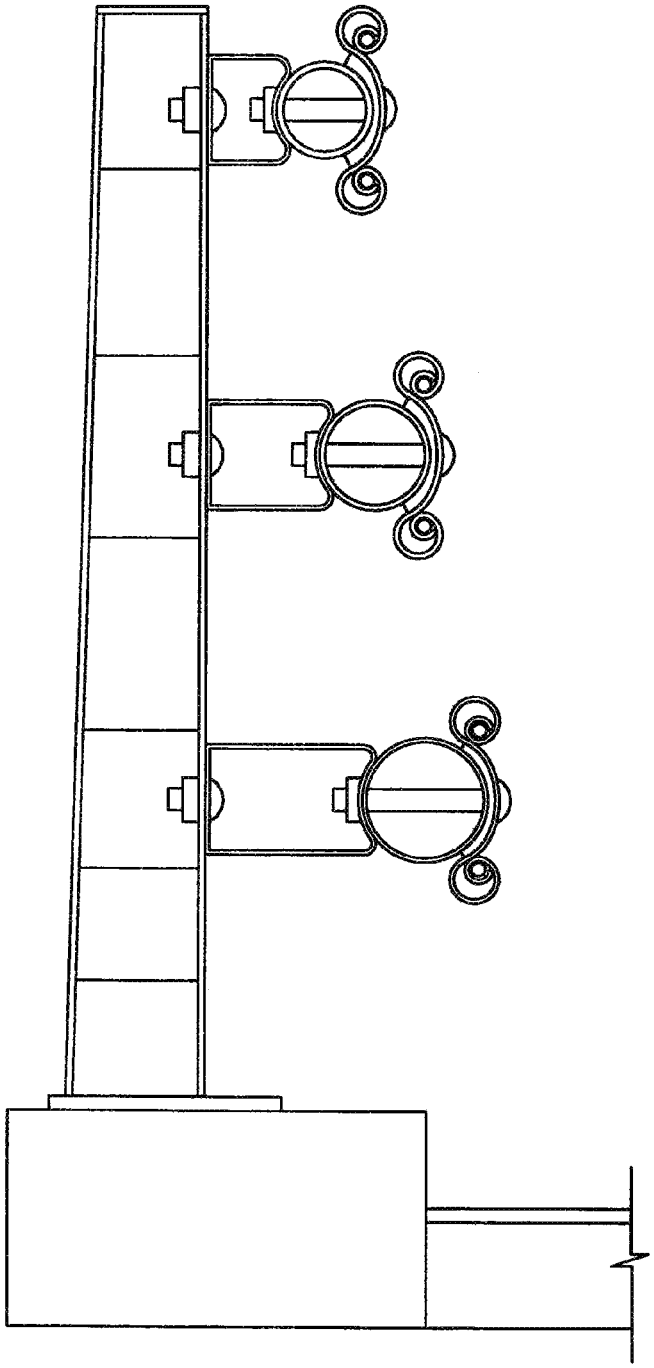
FIG. 7 is a schematic partial left view of the structure of a further multi-layer single-wave beam steel guardrail of the single-wave beam steel guardrails according to the present invention.

The present embodiment is different from the above fourth to seventh embodiments in that, as shown in FIG. 7, in each guardrail unit described above, the distances between three layers of guardrail plate subunits and corresponding posts are gradually reduced from the bottom to the top in the vertical direction. For example, the perpendicular distance between the bottom layer of the guardrail plate subunit and corresponding post is approximately 30 mm larger than the perpendicular distance between the middle layer of the guardrail plate subunit and corresponding post, and the perpendicular distance between the middle layer of the guardrail plate subunit and corresponding post is approximately 30 mm larger than the perpendicular distance between the top layer of the guardrail plate subunit and corresponding post.

Further, in each guardrail unit described above, the widths and the thicknesses of three layers of guardrail plate subunits are gradually increased from the bottom to the top in the vertical direction. For example, from the bottom to the top, the thickness of the bottom layer of the guardrail plate subunit is 3 mm, and the thickness of the middle layer of the guardrail plate subunit is 4 mm, and the thickness of the top layer of the guardrail plate subunit is 4.5 mm.

Further, in each guardrail unit described above, the diameters of the energy-accumulating rings of three layers of guardrail plate subunits are gradually increased from the bottom to the top in the vertical direction.

In the first to eighth embodiments described above, in each guardrail unit, three layers of single-wave beam guardrail plates disposed horizontally and two posts disposed upright may form a frame of the guardrail unit having grading efficiency. When a vehicle crashes with the single-wave beam steel guardrail, the pipe-in-pipe structure of the guardrail plate subunit is deformed to be opened, curled and flattened, so as to absorb the vehicle kinetic energy. Thus, by grating cushion efficiency, the cushioning effect is significant, and the collision time of the vehicle with the single-wave beam steel guardrail is prolonged, and the collision acceleration of the vehicle with the single-wave beam steel guardrail is reduced, which may prevent the vehicle from going across or turning over laterally, and provide a good protection to drivers and passengers. In addition, the appearance of the present invention is ingenious and beautiful, and the anti-collision capability and cushioning capability are strong, which is applicable to roads, urban roads and bridges, especially applicable to speedways in cities in which small vehicles are in a large proportion, and may also be used as residential guardrails. The guardrail according to the present invention may be helpful to improve the overall safety protection ability and the landscape design level of roads and bridges.

In addition, according to the requirement of anti-collision grades which are grade B, grade A, grade SB, grade SA and grade SS respectively, in the guardrail units according to the above embodiments, the number of layers of the guardrail plate subunit, the width of the guardrail plate and the dimensions of the outer circle or the inner circle of the first steel pipe and the second steel pipe of each energy-accumulating ring may be set according to the grades. For example, when the anti-collision grade of the single-wave beam steel guardrail is grade A, i.e. 160 kj, the thickness of each layer of the guardrail plate subunits may be set to 3 mm.

Further, in the above embodiments of the single-wave beam guardrail plate and the single-wave beam steel guardrail, a post cap may be provided at the top of each post.

To sum up, in the embodiments of the single-wave beam guardrail plate and the single-wave beam steel guardrail according to the present invention, the single-wave beam guardrail plate includes a guardrail plate body integrally formed by rolling, and two energy-accumulating rings which have the same structure and are symmetrically disposed in the axial direction at the upper edge and the lower edge of the guardrail plate body. The cross section of the guardrail plate body is in the shape of arc. The two energy-accumulating rings are formed by the upper edge and the lower edge of the guardrail plate body being curled inwardly and helically toward a convex direction of the guardrail plate body, respectively. Based on the single-wave beam guardrail plate, a single-wave beam steel guardrail is provided. When the guardrail plate subunit is being destroyed, corresponding energy-accumulating rings are rapidly opened to absorb the vehicle kinetic energy. When a big vehicle crashes with the single-wave beam steel guardrail, in the vertical direction, the guardrail plate subunit at the lower part of the post having a relatively low rigidity is firstly destroyed, and then above guardrail plate subunits with a relatively high rigidity are destroyed in turn. Thus, the vehicle kinetic energy may be cushioned and steppedly eliminated, and the collision time is prolonged to provide a good protection for drivers and passengers; so as to overcome the disadvantages of low anti-collision grade and weak cushion capacity and unsightly appearance in the prior art. Therefore, the advantages of high anti-collision grade, strong cushion capacity and beautiful appearance may be achieved.

It should be noted that the above description is only the preferred embodiments of the present invention, but not intended to limit the present invention. Though the present invention is described in detail with reference to the above embodiments, those skilled in the art still can make modifications to the technical solutions of the above embodiments, or make equivalent replacements for some technical features in these technical solutions. Any modification, equivalent replacement, improvement and the like made within the spirit and the principle of the present invention should be deemed to fall into the protection scope of the present invention.

What is claimed is:

1. A single-wave beam guardrail plate, comprising a guardrail plate body integrally formed by rolling, and two energy-accumulating rings which have the same structure and are symmetrically disposed in an axial direction at an upper edge and a lower edge of the guardrail plate body, wherein a cross section of the guardrail plate body is in the shape of an arc;

the two energy-accumulating rings are formed by the upper edge and the lower edge of the guardrail plate body being curled inwardly and spirally toward a convex direction of the guardrail plate body, respectively;

each of the two energy-accumulating rings is of a pipe-in-pipe structure in which a first steel pipe is rolled inside a second steel pipe and connected with an inner wall of the second steel pipe, and walls of the first steel pipe and the second steel pipe have a common section near a convex portion of the guardrail plate body; and the single-wave beam guardrail plate comprises a plurality of guardrail plate subunits, and each guardrail plate subunit has the same structure as the single-wave beam guardrail plate.

2. The single-wave beam guardrail plate according to claim 1, wherein the two energy-accumulating rings comprises a first energy-accumulating ring and a second energy-accumulating ring, a common tangent of an outer circle of the first steel pipe of the first energy-accumulating ring and an outer circle of the first steel pipe of the second energy-accumulating ring is perpendicular to a radius of the guardrail plate body;

a common tangent of an outer circle of the second steel pipe of the first energy-accumulating ring and an outer circle of the second steel pipe of the second energy-accumulating ring is perpendicular to the radius of the guardrail plate body;

a middle point of the common tangent of the outer circle of the second steel pipe of the first energy-accumulating ring and the outer circle of the second steel pipe of the second energy-accumulating ring coincides with a middle point of the arc of the guardrail plate body;

a connection line between a center of an inner circle or the outer circle of the first steel pipe of the first energy-accumulating ring and a center of an inner circle or the outer circle of the first steel pipe of the second energy-accumulating ring is perpendicular to the radius of the guardrail plate body;

a connection line between the center of the inner circle or the outer circle of the second steel pipe of the first energy-accumulating ring and the center of the inner circle or the outer circle of the second steel pipe of the second energy-accumulating ring is perpendicular to the radius of the guardrail plate body; and in the first energy-accumulating ring or second energy-accumulating ring, an inner circle of the first steel pipe is an inscribed circle of an inner circle of the second steel pipe.

3. The single-wave beam guardrail plate according to claim 2, wherein in the pipe-in-pipe structure, the radius of the outer circle of the first steel pipe is less than 60% of the radius of the outer circle of the second steel pipe; and in the pipe-in-pipe structure, a wire rope or steel strand passes through each first steel pipe in an axial direction such that a prestress is generated in each guardrail plate subunit.

4. The single-wave beam guardrail plate according to claim 2, wherein in the pipe-in-pipe structure, the radius of the outer circle of the first steel pipe is less than 60% of the radius of the outer circle of the second steel pipe; and in the pipe-in-pipe structure, a wire rope or steel strand passes through each first steel pipe in an axial direction such that a prestress is generated in each guardrail plate subunit.

5. A single-wave beam steel guardrail using the single-wave beam guardrail plate according to claim 1, comprising a plurality of guardrail units sequentially disposed in a transverse direction, in which the plurality of guardrail units are connected by assembling, wherein each of the plurality of guardrail units comprises a plurality of posts disposed upright at intervals, a single layer of or a plurality of layers of guardrail plate subunit(s) disposed transversely at the same side of the posts and being perpendicular to the posts, and a plurality of prevention blocks provided between the single layer of or the plurality of layers of guardrail plate subunit(s) and corresponding posts; a structure of each guardrail plate subunit is the same as that of the single-wave beam guardrail plate;

the single layer of or the plurality of layers of guardrail plate subunit(s) and corresponding prevention blocks are connected by assembling, and the prevention blocks and corresponding posts are connected by assembling; and the single layer of or the plurality of layers of guardrail plate subunit(s) of each of the plurality of guardrail units and corresponding guardrail plate subunit(s) of adjacent guardrail unit are connected by assembling.

6. The single-wave beam steel guardrail according to claim 5, wherein assembly plate(s) for connecting adjacent guardrail plate subunits is provided near corresponding posts at the connections between the single layer of or the plurality of layers of guardrail plate subunit(s) of each guardrail unit and corresponding guardrail plate subunit(s) of the adjacent guardrail unit, the assembly plate(s) and corresponding guardrail plate subunit(s) are connected by assembling, and the assembly plate(s) and corresponding prevention block(s) are connected by assembling.

7. The single-wave beam steel guardrail according to claim 6, wherein the assembly plate is a connection steel plate.

8. The single-wave beam steel guardrail according to claim 7, wherein reinforcing steel pipe(s) is provided in the axial direction in arc groove(s) of the single layer of or the plurality of layers of guardrail plate subunits of each guardrail unit respectively, the reinforcing steel pipe(s) is located between corresponding assembly plate(s) and prevention block(s); and each layer of the guardrail plate subunits and corresponding assembly plate, the reinforcing steel pipe are connected by assembling, and each layer of the guardrail plate subunit and corresponding prevention block are connected by assembling.

9. The single-wave beam steel guardrail according to claim 8, wherein in each guardrail unit, distances between the plurality of layers of guardrail plate subunits and corresponding posts are the same or gradually reduced from the bottom to the top in a vertical direction;

widths and a thicknesses of the plurality of layers of guardrail plate subunits are the same or gradually increased from the bottom to the top in the vertical direction;

diameters of the energy-accumulating rings of the plurality of layers of guardrail plate subunits are the same or gradually increased from the bottom to the top in the vertical direction; and diameters of the reinforcing steel pipes provided correspondingly to the plurality of layers of guardrail plate subunits are the same or gradually reduced from the bottom to the top in the vertical direction.

10. The single-wave beam steel guardrail according to claim 6, wherein reinforcing steel pipe(s) is provided in the axial direction in arc groove(s) of the single layer of or the plurality of layers of guardrail plate subunits of each guardrail unit respectively, the reinforcing steel pipe(s) is located between corresponding assembly plate(s) and prevention block(s); and each layer of the guardrail plate subunits and corresponding assembly plate, the reinforcing steel pipe are connected by assembling, and each layer of the guardrail plate subunit and corresponding prevention block are connected by assembling.

11. The single-wave beam steel guardrail according to claim 10, wherein in each guardrail unit, distances between the plurality of layers of guardrail plate subunits and corresponding posts are the same or gradually reduced from the bottom to the top in a vertical direction;

widths and a thicknesses of the plurality of layers of guardrail plate subunits are the same or gradually increased from the bottom to the top in the vertical direction;

diameters of the energy-accumulating rings of the plurality of layers of guardrail plate subunits are the same or gradually increased from the bottom to the top in the vertical direction; and diameters of the reinforcing steel pipes provided correspondingly to the plurality of layers of guardrail plate subunits are the same or gradually reduced from the bottom to the top in the vertical direction.

12. The single-wave beam steel guardrail according to claim 5, wherein reinforcing steel pipe(s) is provided in the axial direction in arc groove(s) of the single layer of or the plurality of layers of guardrail plate subunits of each guardrail unit respectively, the reinforcing steel pipe(s) is located between corresponding assembly plate(s) and prevention block(s); and each layer of the guardrail plate subunits and corresponding assembly plate, the reinforcing steel pipe are connected by assembling, and each layer of the guardrail plate subunit and corresponding prevention block are connected by assembling.

13. The single-wave beam steel guardrail according to claim 12, wherein in each guardrail unit, distances between the plurality of layers of guardrail plate subunits and corresponding posts are the same or gradually reduced from the bottom to the top in a vertical direction;

widths and a thicknesses of the plurality of layers of guardrail plate subunits are the same or gradually increased from the bottom to the top in the vertical direction;

diameters of the energy-accumulating rings of the plurality of layers of guardrail plate subunits are the same or gradually increased from the bottom to the top in the vertical direction; and diameters of the reinforcing steel pipes provided correspondingly to the plurality of layers of guardrail plate subunits are the same or gradually reduced from the bottom to the top in the vertical direction.

14. The single-wave beam steel guardrail according to claim 5, wherein in the single-layer of or the plurality of layers of guardrail plate subunits, each layer of guardrail plate subunit include single-side guardrail plate subunit or double-side guardrail plate subunit;

a structure of the single-side guardrail plate subunit is the same as that of the single-wave beam guardrail plate, and the double-side guardrail plate subunit is formed by oppositely assembling two single-wave beam guardrail plates together; and in the double-side guardrail plate subunit, the arc convex portions of the guardrail plate bodies of the two single-wave beam guardrail plates are disposed oppositely, and the guardrail plate bodies thereof are connected by assembling.

* * * * *